United States Patent [19]

Postler et al.

[11] Patent Number: 4,953,813

[45] Date of Patent: Sep. 4, 1990

[54] EJECTABLE MEMBER WITH PARACHUTE

[75] Inventors: Gunter Postler, Rothenbach/Peg.; Erich Bock, Nuremberg; Wolfgang von Entress-Fursteneck, Leinburg; Werner Rudenauer, Roth, all of Fed. Rep. of Germany

[73] Assignee: Diehl GmbH & Co., Nuremberg, Fed. Rep. of Germany

[21] Appl. No.: 291,688

[22] Filed: Dec. 29, 1988

[30] Foreign Application Priority Data

Jan. 8, 1988 [DE] Fed. Rep. of Germany ..... 3800330

[51] Int. Cl.[5] ..... B09D 17/00

[52] U.S. Cl. ..... 244/147; 102/339; 102/387

[58] Field of Search ..... 244/147, 148, 149; 102/387, 337, 340, 348, 401, 378, 411; 89/1.14, 1.57

[56] References Cited

U.S. PATENT DOCUMENTS

| | | | |
|---|---|---|---|
| 2,650,127 | 8/1953 | Carlson | 294/83 |
| 3,442,474 | 5/1969 | Miller et al. | 244/147 |
| 3,730,099 | 5/1973 | Schopp | 102/339 |
| 3,749,017 | 7/1973 | Peterson | 244/147 |
| 3,817,179 | 6/1974 | Ludtke et al. | 102/387 |
| 4,587,902 | 5/1986 | Lindner et al. | 102/213 |

FOREIGN PATENT DOCUMENTS

| | | | |
|---|---|---|---|
| 0992931 | 7/1951 | France | 89/1.57 |

*Primary Examiner*—Charles T. Jordan
*Assistant Examiner*—Rochelle Lieberman
*Attorney, Agent, or Firm*—Scully, Scott, Murphy & Presser

[57] ABSTRACT

An ejectable or launchable member which possesses a storage space for a parachute. An ejectable member of the type which is under consideration herein has the dimensions of the constructional elements reduced in the periphery of a parachute cassette, so as to resultingly provide for savings in deployment weight, and at a given caliber, to be able to increase the amount of storage space which is available for the parachute.

12 Claims, 1 Drawing Sheet

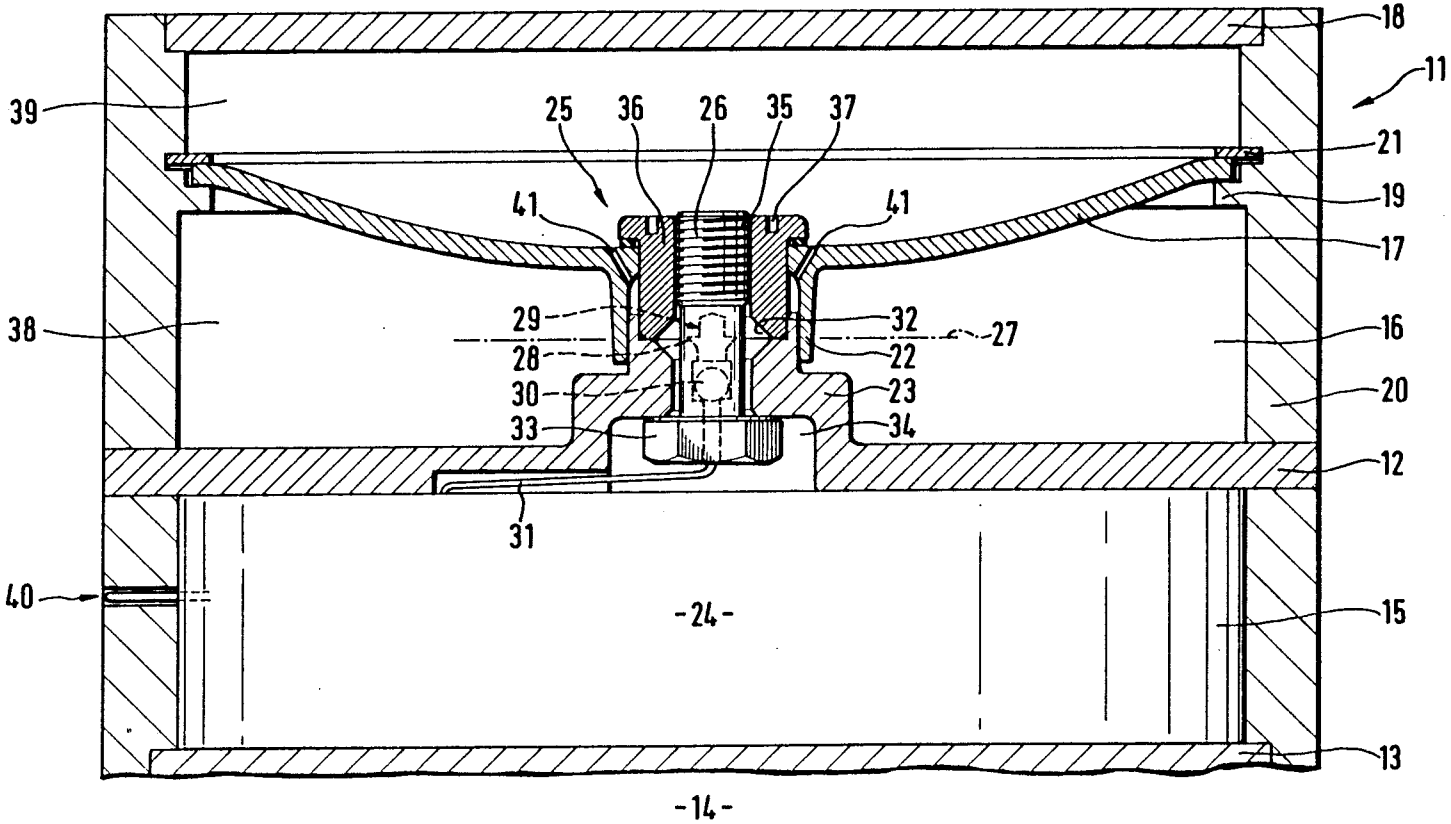
11
18
21
19
17
16
20
12
15
13
27
41
32
22
23
34
37
35
26
36
25
41
29
28
30
33
31
-24-
-14-
39
38
40

EJECTABLE MEMBER WITH PARACHUTE

BACKGROUND OF THE INVENTION

1. Field of the Invention

The present invention relates to an ejectable or launchable member which possesses a storage space for a parachute.

2. Discussion of the Prior Art

In particular, the ejectable member of the type under consideration herein may be in the configuration of an article of submunition with a target-detecting arrangement which descends in a parachute-braked mode into a target area, such as has become generally known from the disclosure of U. S. Pat. No. 4,587,902, commonly assigned to the assignee of the present application.

In order to release the parachute for unfolding thereof after only a certain time subsequent to the ejected release of the member from its deploying carrier, especially a twisting parachute, a parachute cassette is positioned rearwardly of the active component of the member. The cassette is releasable through a timing control device; for example, so as to by being raised away from the rear wall of the active component, open the storage space for the parachute and to draw out the parachute from its storage pouch in order to initiate the unfolding thereof. The orderly functioning in the separation of the parachute cassette from the active component through such a timing control device necessitates, above all, that the latching and release mechanism thereof be arranged axially-symmetrical, and because of reasons in obtaining space-savings, preferably axially; and provides for the necessary clearance for the releasing motion sequence evidences in engagement from the active component to the parachute cassette. In order to be able to additionally achieve an acceleration and vibration-resistant assembly between the active component and the parachute cassette, especially an assembly which can be fired from a weapon barrel or launch tube, there is required a constructive enclosure of the periphery of the cassette with fastening thereof to the periphery of the active component, which in all instances necessitates a relatively large volume for the assumption of the generated transverse or shearing forces and of the axial clamping elements.

SUMMARY OF THE INVENTION

Accordingly, in recognition of these conditions it is a primary object of the present invention to equip an ejectable member of the type which is under consideration herein in such a manner that the dimensions of the constructional elements can be reduced in the periphery of the parachute cassette, so as to resultingly provide for savings in deployment weight, and at a given caliber, to be able to increase the amount of storage space which is available for the parachute.

The foregoing object is inventively attained in that the connection between the parachute cassette and the active component is implemented in that behind the rear wall of the parachute cassette, the latter axially clamped in position in the center thereof through the intermediary of a pyrotechnically severable connector element.

Pursuant to the foregoing, there is effectuated an axial and radial fastening in position of the parachute cassette on the active component in the center of the rear wall thereof, so that in this instance there is carried out the mutual fixing in position; and in the region of the periphery of the cassette, there are no longer assumed any forces which must be transferred to the active component. This provides the desirable result that the cassette can be constructed thin-walled and, as a consequence, is light in weight and possesses a large internal storage space in relationship to its diameter; and whereby it is possible to ensure the presence of unambiguous kinematic relationships during the severing procedure between the cassette and the active component through simple central axial guidance measures. As a rupturable clamping element intermediate the cassette and the rear wall of the active component, there is expediently employed a bolt with an encompassing rupture location extending about in the plane of separation; which rupture location is pyrotechnically severable; preferably in a configuration of pyrotechnic severing screws which have been already commercialized in the field of the experimental technology for special constructive tasks by the company Dynamit Nobel AG.

BRIEF DESCRIPTION OF THE DRAWING

Additional alternatives and modifications, as well as further features and advantages of the invention can now be readily ascertained from the following detailed description of an exemplary embodiment of the invention, taken in conjunction with the accompanying single figure of drawing, illustrating a transverse cross-section a generally preferred construction of the ejectable member with parachute.

DETAILED DESCRIPTION

The single figure of the drawing illustrates, in an axially-extending longitudinal sectional view, the pyrotechnically separatable axial assembly of a rotational parachute cassette in the rearward region of an ejectable member, especially a submunition member incorporating a search head or target-detecting arrangement.

The illustrated ejectable member 11 in the shape of an article of submunition possesses an electromechanical-electronic safe-and-arm and fuze device 15 intermediate its rear wall 12 and a rearward damming 13 for its active charge 14 and coaxially therewith, behind the rear wall 12, a parachute cassette 16. A rotational parachute (not shown) is folded into the cassette in front of a separating wall 17, and a braking parachute (not shown) is folded is behind the separating wall 17, with a rearward closure being provided by a cassette cover 18. Through the form-closed positioning of the separating wall 17 of the cassette between an encompassing bearing flange 19 on the inner mantle surface of the cassette wall structure 20, and a spring ring 21 which is inserted therebehind, there is obtained an axial securing and radial centering between the cassette and the separating wall 17. The separating wall 17, in turn, is radially guided and forwardly fixed in place, by means of a forwardly projecting sleeve 22, against a rearwardly-extending convexity 23 in the rear wall 12. The rearward fixing in place of the separating wall 17 (and thereby the cassette 16) against the rear wall 12 (and thereby against the active component 24) is effected by means of a radially-centered and axially tensioned connector element 25 which is centrally positioned in place in the rear wall 12. This element essentially possesses the configuration of a bolt 26 which, in the plane of separation 27, is provided with an axial rupturing location 28. This location can be burst apart by means of a pyrotechnic detonating charge 29, which is electrically initiatable through a detonating pill 30 which is located within the interior of the connecting bolt 26, and is controlled from the fuze device 15 through a cable connection 31. The triggering leads to an axial disintegration of the bolt 26 along the plane of separation 27 with the flanging out of the mantle surface of the bolt into the space held available for this purpose by a channeled groove 32 extending thereabout in the plane of separation 27.

The gas pressure from the reaction which is released during the breaking open of the clamping bolt 26, leads to an excess pressure in the region of the channeled groove 32 and therebY, in consequence of the telescoping interengagement of the convexity 23 and the sleeve 22, to an axially conducted raising away of the parachute cassette 16 from the active component 24 with the axial separation of the two parts of the bolt 26 from each other in the plane of separation 27.

The pyrotechnically severable clamping bolt 26 can be imparted its axial tensioning intermediate the rear wall 12 of the active component and the separating wall 17 of the cassette by means of form-closed securing elements (cross-pins, spring plate) or form-fittedly in the type of rivet heads. However, from the standpoint of assembly it is simplest to provide a configuration as a short threaded bolt 26, which is coaxially screwed into at least one of the parts which is to be clamped (rear wall 12, separating wall 17) and, for example, axially contacts against the other part by means of a screw head 33.

In the illustrated preferred exemplary embodiment, there is provided a threaded bolt 26 whose screw head 33 is located in a recess 34 ahead of the convexity 23 in the rear wall, such that the housing of the fuze device 15 is supported in flat contact over a large surface against the rear wall 12 of the active member. The thread 35, in contrast with the illustrated embodiment, need not directly engage into the sleeve 22 of the separating wall, or as shown engage into a nut in the shape of a flanged sleeve 36 which is inserted rearwardly into the sleeve 22, with a rearward internal profiling 37 for the attachment of a worktool in order to produce a counter-torque during the screwing in of the severing 26. The forward end of the sleeve 36 is so dimensioned in its cross-section so that, in conjunction with the bordering rearward end of the convexity 23 in the rear wall, detent 33 towards the separating bolt 26, facing towards the severing bolt 26 there is obtained the encompassing channeled groove 32 in the plane of separation 27. On the other hand, the encompassing end surface region of the convexity 23 in the rear wall engages coaxially between the flanged sleeve 36 and the forward end of the sleeve 22 on the separating wall, so as to hereby produce the axial guiding function during the raising away in the plane of separation 27, and to form a labyrinth seal against passage of the reaction gases from the detonating charge into the storage space 38 for the spin parachute.

Upon the expulsion of the ejectable submunition member 11 from its carrier, such as a deploying projectile, a (flow-dynamically or constructively produced) tensile force behind the parachute cassette 16 causes the raising away of its rearward cover 18 and thereby the pulling out of a braking parachute which is fastened thereto from the storage space 39 for the braking parachute rearwardly of the separating wall 17 of the cassette. Concurrently, by means of a triggering sensor 40 (such as a feeler pin, which is moved under a spring-loading into its switched-on position upon release from the carrier) there is activated an electronic timing circuit, so as to open the storage space 38 for the spin parachute pursuant to a system-required predetermined braking time interval. For this purpose, there is activated the detonating charge 29; in essence, the clamping bolt 26 is burst by the gas pressure from the pyrotechnic reaction with initiation of the axial severing movement. The mutual overlapping of the sleeve 22 of the separating wall and convexity 23 in the rear wall ensures that, upon the bursting apart of the clamping bolt 26, neither thermal or mechanical damages will be encountered by the spin parachute which is folded into the storage space 38 by means of the opening plane of separation 27. Already prior to the opening of this engagement 22 - 23 is the excess pressure from the reaction gas reduced by means of narrow equilibrating passageways 41 which extend through the separating wall 17 into the rearwardly opened space 39 which is free because of the already withdrawn braking parachute; such that also upon the gliding apart of the telescopic engagement 22 - 23, hot reaction gases from the triggering charge 29 can no longer lead to any damages in the storage space 38 for the spin parachute.

The operational unit which is already somewhat raised by the gas pressure from the reaction, and which consists of the separating wall 17 of the cassette and the therewith form-fittingly connected wall structure 20 of the cassette, is now completely lifted away from the rear wall 12 by the rearward acting tensile force from the braking parachute, and as a result from the active component 24 of the ejectable member, with the folding out of the spin parachute (not shown) which is fastened to the separating wall 17 of the cassettes and fixed in position on the rear wall 12 of the active component, so as to ensure a uniform or constant rotational movement during the braked continued descent of the ejectable member into its target area.

What is claimed is:

1. An ejectable member having a storage space for a parachute; a rear wall on said ejectable member; a cassette for said parachute rearwardly of said rear wall; a pyrotechnically severable connector element for centrally axially clamping said cassette to said rear wall, said storage space for said parachute being separated in the region of a predetermined plane of separation from said pyrotechnically severable connector element by a telescopable seal with a sleeve.

2. An ejectable member as claimed in claim 1, wherein said connector element comprises a clamping bolt having a rupture location extending about a detonating charge in said plane of separation.

3. An ejectable member as claimed in claim 2, wherein axially-telescopically interengaging guide means are provided on the cassette and on the rear wall in said plane of separation.

4. An ejectable member as claimed in claim 3, wherein said guide means include an encompassing channeled groove facing said clamping bolt in said plane of separation.

5. An ejectable member as claimed in claim 3, wherein said guide means comprise a labyrinth seal.

6. An ejectable member as claimed in claim 2, wherein said connector element comprises a pyrotechnically severable threaded bolt having an axially short screw thread rearwardly of the severing detonating charge.

7. An ejectable member as claimed in claim 6, wherein said threaded bolt includes a screw head at one end and has said axial screw thread screwed into an internal screw thread formed in said sleeve.

8. An ejectable member as claimed in claim 6, wherein a flanged sleeve having an internal screw thread is axially tensioned against a rearwardly-extending convexity in the rear wall of said ejectable member.

9. An ejectable member as claimed in claim 1, wherein the space in the surroundings of the connector element which is sealed relative to said storage space is connected through equilibrating passageways with the open space rearwardly of the parachute cassette for the reduction of the gas pressure from the pyrotechnic reaction.

10. An ejectable member as claimed in claim 1, wherein said cassette includes a wall rearwardly closing said storage space for the parachute, the center of said wall including a sleeve extending coaxially about the connector element, said sleeve clamping the wall axially against a convexity in the rear wall of the ejectable member.

11. An ejectable member as claimed in claim 10, wherein a pyrotechnically-activatable severing bolt has a head arranged in a central recess in front of the convexity in the rear wall.

12. An ejectable member as claimed in claim 8, wherein said threaded bolt includes a screw head at one end and has said axial screw thread threadingly engaging said internal screw thread in said flanged sleeve.

* * * * *